United States Patent [19]

Yamaizumi

[11] 4,436,494

[45] Mar. 13, 1984

[54] PLUNGER PUMP

[75] Inventor: Kazuo Yamaizumi, Tokyo, Japan

[73] Assignee: Nagano Keiki Seisakusho, Ltd., Tokyo, Japan

[21] Appl. No.: 316,169

[22] Filed: Oct. 29, 1981

[30] Foreign Application Priority Data

Mar. 20, 1981 [JP] Japan ..... 56/40839

[51] Int. Cl.[3] ..... F04B 21/00

[52] U.S. Cl. ..... 417/403; 417/511

[58] Field of Search ..... 417/402, 403, 404, 511, 417/552, 553, 555, 556; 91/321; 277/200, 212 FB

[56] References Cited

U.S. PATENT DOCUMENTS

| | | | |
|---|---|---|---|
| 1,595,939 | 8/1926 | Hukill et al. | 91/321 |
| 2,980,080 | 4/1961 | Joelson | 91/321 |
| 3,094,938 | 6/1963 | Blomeke et al. | 417/511 X |

FOREIGN PATENT DOCUMENTS

| | | | |
|---|---|---|---|
| 1212372 | 3/1966 | Fed. Rep. of Germany | 277/212 FB |

*Primary Examiner*—Leonard E. Smith

*Attorney, Agent, or Firm*—Flynn, Thiel, Boutell & Tanis

[57] ABSTRACT

A plunger pump wherein a bellows is provided between the plunger and the plunger case to thereby protect a slide surface of the plunger from a pressure-fed fluid such as inorganic paint, zinc rich paint.

In this plunger pump, the pressure-fed fluid is allowed to flow between the outer surface of the bellows and the inner surface of the plunger case, only the removal of the plunger after use can expose the outer surface of the bellows so as to facilitate removing the pressure-fed fluid such as the coating composition including paint and cleaning the bellows, and moreover, the effective diameter of the bellows is made equal in value to the outer diameter of a portion, which is slidable on the plunger case and projected into a portion communicated with the interior of the bellows so as to eliminate an occurrence of an unusual deformation of the bellows.

7 Claims, 1 Drawing Figure

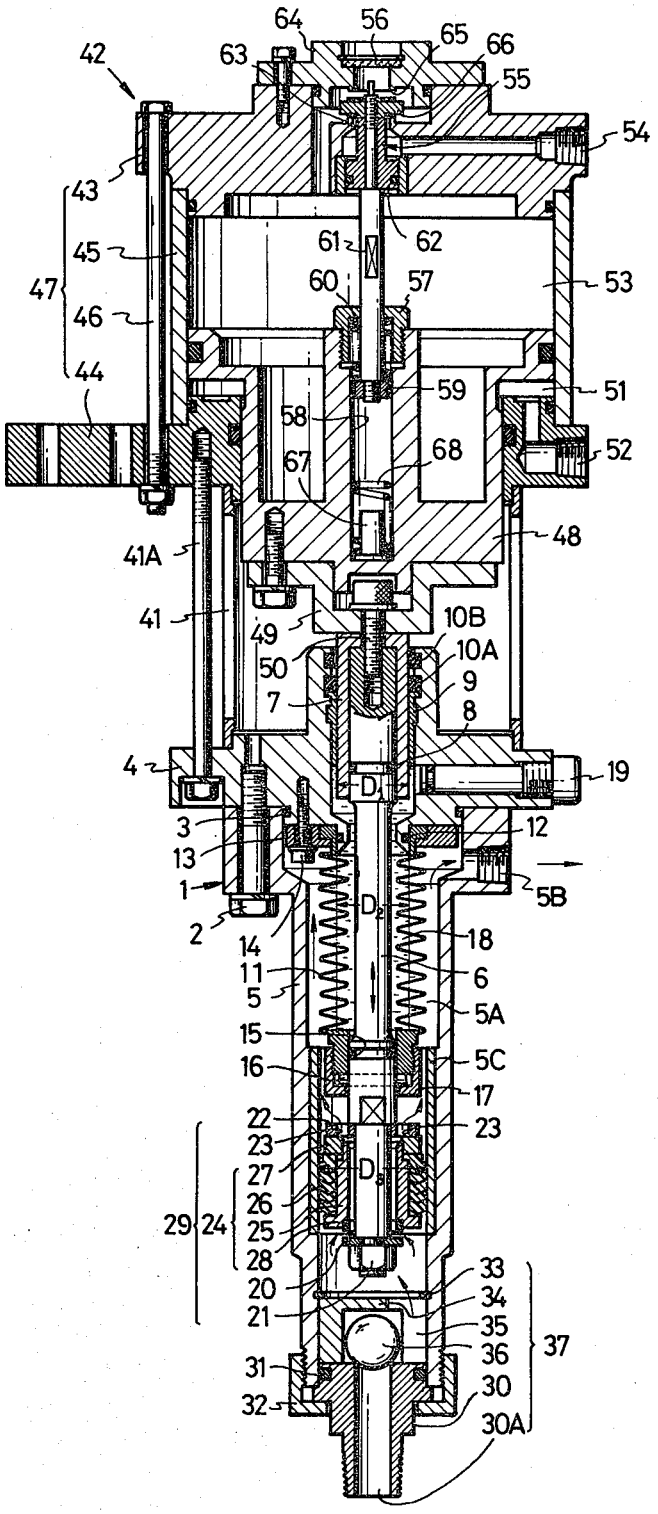
64
56
65
66
63
55
42
54
43
45
47
46
44
61
62
60
57
53
59
51
58
52
67
68
48
41A
41
49
10B
50
10A
9
7
8
4
19
3
12
13
1
5B
2
14
18
11
6
5
5A
15
5C
16
17
22
23
23
27
26
25
28
29
24
33
20
34
21
35
36
37
31
30
32
30A

PLUNGER PUMP

BACKGROUND OF THE INVENTION

1. Field of the Invention

This invention relates to a plunger pump wherein an inlet valve and a discharge valve are operated by a reciprocable plunger to feed a predetermined quantity of fluid under pressure.

2. Description of the Prior Art

Heretofore, there have been utilized plunger pumps of various types for feeding various fluids such as coating composition including paint under pressure. With these plunger pumps, when the pressure-fed fluid is inorganic paint, zinc rich paint being in the form of slurry and including therein solid tramp materials and the like, such disadvantages have been presented that these paints tend to wear slide portions of the plunger and deteriorate the lubricating properties, thus rusulting in an unstabilized operation.

In view of the above, such a plunger pump has been developed that, in a plunger pump for a zinc rich paint and the like, for the purpose of protecting a slide portion between a plunger and a plunger case, a bellows is provided between the plunger and the plunger case to thereby completely separate the slide portion of the plunger from the zinc rich paint which is a pressure-fed fluid due to the presence of the bellows (Refer to Japanese patent application publication No. 2721/1977). However, with the plunger pump of the type described, in which the pressure-fed fluid flows through the plunger, the pressure-fed fluid should necessarily pass through the interior of the bellows. Consequently, when the pump is disassembled to be cleaned after use, unless the bellows is entirely removed, the paint and the like contained in the bellows cannot be removed, and further, a pair of bellows are provided at opposite ends of the plunger, respectively, due to the construction for allowing the pressure-fed fluid passes through the interior of the plunger, whereby it takes long period of time, as a whole, after use, thus presenting such drawbacks that the operation is performed at a low efficiency and the provision of the pair of bellows and the like results in increased costs of manufacture.

Further, in the plunger pump described in the aforesaid patent application publication No. 2721/1977, oil used for countering the pressure of the fluid fed through the bellows under pressure is filled in a space formed between the bellows and the plunger case. However, to prevent the bellows from being deformed to a high extent, the pump is designed such that the inner diameter of the plunger case is substantially equal to or slightly larger than the maximum diameter of the bellows. Because of this, air foams mixed into the oil while the oil is being filled into the space formed between the outer peripheries of the bellows and the inner periphery of the plunger case, tend to be held between respective ribs of the bellows and it is very difficult to remove these foams, whereby a pressure ballance between the interior and the exterior of the bellows may be lost due to the presence of these foams, which possibly leads to damages of the bellows.

Consequently, it has been indispensable to remove the foams from within the liquid such as the oil for countering the pressure of the pressure-fed fluid, and, heretofore, a special filling apparatus has been required for filling the liquid, thus necessitating to perform a very troublesome filling operation.

SUMMARY OF THE INVENTION

A first object of the present invention is to provide a plunger pump usable for inorganic paint and the like, having general-purpose properties and being easy in the treatment after use, such as cleaning and the like.

A second object of the present invention is to provide a plunger pump free from an unusual deformation of the bellows caused by the movement of a plunger.

To achieve the first object, the present invention contemplates that a bellows is provided in a space formed between a plunger and a plunger case to protect the plunger against inorganic paint and the like, a flow path for a pressure-fed fluid is provided in a space formed between the outer surface of the bellows and the inner surface of the plunger case for allowing the pressure-fed fluid to flow therethrough, and, after use, only the removal of the plunger case makes it possible to expose the outer surface of the bellows, so that the pressure-fed fluid such as coating composition including paint adhered to the bellows can be readily removed.

To achieve the second object, the present invention contemplates that the outer diameter of a portion of the plunger, which is slidable on the plunger case and projected into a portion communicated with the interior of the bellows is made equal in value to the effective diameter of the bellows.

BRIEF DESCRIPTION OF THE INVENTION

The drawing is a sectional view showing an embodiment of the present invention.

DETAILED DESCRIPTION OF THE PREFERRED EMBODIMENT

A plunger case 1 comprises an upper case portion 4 and a lower case portion 5, both of which are detachably connected to each other by means of a bolt 2 and hermetically sealed by means of an O-ring 3. A plunger 6 is received in the plunger case 1 in such a manner that the plunger 6 is slidably supported and one end portion thereof (in the drawing, the lower end portion) is surrounded by the plunger case 1. A socket 7 is detachably coupled to the upper portion of the plunger 6 as viewed in the drawing. An O-ring 8 is interposed between the socket 7 and the plunger 6, and the socket 7 is slidable on the upper case portion 4 through a sleeve 9, a lip seal 10A and a dust seal 10B.

Fixed to the end face of the upper case portion 4 received in the lower case portion 5 is one end of the bellows 11 made of fluorine plastics and the like through an O-ring 12 by means of a fastner 13 and a screw 14. The other end of the bellows 11 is solidly secured to the intermediate portion of the plunger 6 through an O-ring 15. The fixation between the bellows 11 and the plunger 6 is effected by means of a pin 16 penetrating the plunger 6 and a box nut 17 rotatable relative to the plunger 6, abutted at the inner surface thereof against the pin 16 and theadably coupled into the lower end portion of the bellows 11. Filled in the bellows 11 and a space defined by the inner diameter of the upper case portion 4 is liquid 18 such as oil and the like, and the fill quantity, color shade and the like of the liquid 18 can be inspected through a sight window 19 provided in the upper case portion 4. The outer diameter $D_1$ of the socket 7 coupled onto the upper end portion of the plunger 6 is made equal to the effective diameter $D_2$ of the bellows 11 (i.e. $D_1=D_2$), so that a variation of volume in the bellows 11 adapted to expand or shrink in accordance with the linear movement of the plunger 6 can be matched with a variation of volume in a liquid filled portion of the upper case portion 4 due to the simultaneous movements of the socket 7 constituting a part of the plunger 6. With this arrangement, when the plunger 6 moves, the bellows 11 suitably expands or shrinks at all times without any unnecessary expansion or shrinkage in the radial direction thereof, whereby the pressure balance between the liquid 18 in the bellows 11 and the pressure-fed fluid flowing outside the bellows 11 is not lost, so that any harmful deformation of the bellows 11 due to a lost pressure balance, which would otherwise occur, can be avoided. Further, a relatively large gap is formed between the outer periphery of the bellows 11 and the lower case portion 5 to serve as a flow path 5A for the pressure-fed fluid, and this flow path 5A is communicated with a discharge port 5B formed at the upper side surface of the lower case portion 5.

Solidly secured through a nut 21 to the inner end (the lower end in the drawing) of the plunger 6 is a receiving seat 20, and a perforated plate 22 is pressingly fixed and abutted against a stepped portion formed on the plunger 6 at a position upwardly spaced a predetermined distance apart from the lower end of the receiving seat 20. This perforated plate 22 is formed therein with a plurality of holes 23 being disposed on a circle concentric with the plunger 6 in a sectioned lotus root fashion as viewed in plan view, so that the pressure-fed fluid such as coating composition including paint and the like can flow through the holes 23.

A valve body 24 is a predetermined distance movably provided on the plunger 6 between the receiving seat 20 and the perforated plate 22. This valve body 24 comprises: a cylindrical member 25 having a flange forming a gap of a predetermined size between the outer diameter of the plunger 6 and itself; a plurality of V-shaped packings 26 formed of a material such as fluorine plastics, coupled onto the outer periphery of the cylindrical member 25 and closely attached to and slidable on a thin wall pipe 5C solidly secured at the peripheral surface thereof to the inner surface of the lower case portion 5; a nut 27 fixed to the upper end of the cylindrical member 25 for solidly securing the V-shaped packings 26 to the cylindrical member 25; and a valve seat 28 made of a sintered hard alloy or the like, having an inner diameter equal to the inner diameter of the cylindrical member 25 and fixed to the cylindrical member 25 in a manner to partially project from the undersurface of the cylindrical member 25. With this arrangement, when the plunger 6 is moved downwardly, i.e. in a direction of closing an inlet valve to be described hereinafter, the valve body 24 as a whole is elevated until it abuts against the perforated plate 22 to separate the valve seat 28 from the receiving seat 20, the valve body 24 is opened whereby the upper and the lower portions of the valve body 24 are communicated with each other through a space formed between the valve seat 28 and the receiving seat 20, spaces formed within the inner peripheries of the valve seat 28 and the cylindrical member 25 and the holes 23 of the perforated plate 22. While, when the plunger 6 moves in the reverse direction, i.e. upwardly, the valve body 24 as a whole is lowered to abut the valve seat 28 against the receiving seat 20, whereby the valve body 24 is closed, so that the vertical communication through the valve body 24 can be blocked. In this case, the outer diameter of the V-shaped packings 26, i.e. the inner diameter $D_3$ of the pipe 5C is $\sqrt{2}$ of the effective diameter $D_2$ of the bellows 11, that is, the ratio between the entire area within the outer diameter of the cross section of the V-shaped packings 26 and the effective cross-sectional area of the bellows 11 becomes 2:1, and with this arrangement, the variation of volume of a portion below the V-shaped packings 26 due to the movement of the plunger 6 becomes two times the variation of volume of a portion above the V-shaped packings 26, i.e. two times the variation of volume on the side of the bellows 11. Consequently, when the plunger 6 is in its lowering process, a quantity $Q_1$ of the fluid, which has been below the V-shaped packings 26, flowing into the portion upwardly of the V-shaped packings 26 through the valve seat 28 due to the movement of the V-shaped packings 26 becomes two times the value obtained by subtracting a volume $Q_3=\frac{1}{2}Q_1$ formed by the expansion of the bellows 11 to displace the fluid from a volume $Q_2=Q_1$ in a space formed above the V-shaped packings 26 in accordance with the downward movement of the V-shaped packings 26, whereby the discharge is also effected through the discharge port 5B even when the plunger 6 is extended downwardly, the quantity of discharge then being $\frac{1}{2}Q_1$. During an elevating process of the plunger 6, the valve seat 28 is closed to stop the flow-in of the fluid from below the V-shaped packings 26, and a difference between a decrease in the fluid receiving volume on the side of the bellows 11 due to the elevation of the plunger 6, i.e. the V-shaped packings 26 and an increase in the fluid receiving volume due to the shrinkage of the bellows 11 becomes $\frac{1}{2}Q_1$ being equal to the quantity of discharge described above. Consequently, during both the elevating and lowering processes of the plunger 6, the fluid can be continuously discharged at the same quantity. Here, the receiving seat 20, the nut 21, the perforated plate 22 and the valve body 24 constitute the discharge valve 29.

Inserted into the bottom end of the lower case portion 5 through an O-ring 31 is a valve seat 30 being of a hollow plug shape provided on the outer periphery of the forward end thereof with a threaded portion and formed at the bottom end thereof with an inlet port 30A. This valve seat 30 is fixed to the lower case portion 5 through a box nut 32, interposed between the upper end of this valve seat 30 and a C-ring 33 fixed to the inner surface of the lower case portion 5 is a ball support member 34, which is of an inverted bottomed cylinder form and formed at the side wall and a part of the bottom surface thereof with a cut-away portion 35. Additionally, a ball 36 is vertically movably received in the support member 34 and may block the upper end edge of a hole formed in the valve seat 30. With this arrangement, when the ball 36 is raised, the pressure-fed fluid such as the paint and the like can be sucked in through the valve seat 30, the cut-away portion 35 of the support member 34 and the C-ring 33. Whereas, when the ball 36 is lowered to abut against the seat valve 30, the flow of the pressure-fed fluid is blocked. The valve seat 30, the C-ring 33, the ball support member 34 and the ball 36 constitute an inlet valve 37 of a ball valve type.

Fixed to the upper case portion 4 through a perforated support cylinder 41 by means of a bolt 41A is an air cylinder 42 as a plunger driving source. This air cylinder 42 comprises: a case 47, in which an upper and a lower head covers 43 and 44 are securely connected to each other through a cylindrical body 45 by means of a tight bolt 46; and a piston 48 slidably received in this case 47. The bottom end of this piston 48 is connected to the plunger 6 by means of a connector 49 and a connecting bolt 50, so that the plunger 6 can be reciprocated in accordance with the movement of the piston 48.

The aforesaid lower head cover 44 is provided therein with a path 52 for constantly feeding compressed air into a lower chamber 51 disposed at the undersurface of the head of the piston 48 and the upper head cover 43 is formed therein with a path 54 for supplying compressed air to a chamber 53 disposed at the top surface of the piston 48 when necessary. A change-over valve 55 is formed at the intermediate portion of the path 54, and, through the action of this change-over valve 55, compressed air is fed to the chamber 53 disposed at the top surface of the piston 48 through the path 54, or the air in the chamber 53 disposed at the top surface of the piston 48 is discharged to atmosphere through a filter 56.

The change-over valve 55 comprises: a shaft 61 penetrating the box nut 57 threadably coupled into the piston 48, inserted at one end portion thereof into a blind hole 58 formed at the central portion of the piston 48 and wound around by a compression coil spring 60 confined between the box nut 57 and the inserted portion thereof; a pressure receiving member 62 secured to the shaft 61 at a position close to the upper end of the shaft 61 and slidable on the inner surface of the upper head cover 43; and a valve body 66 secured to the upper end portion of the shaft 61, and adapted to abut against a valve seat 63 provided in the upper head cover 43 at the intermediate portion of the path 54 and against a valve seat 65 provided on a cap 64 being secured to the upper head cover 43 and having the filter 56, respectively. With this arrangement, when the piston 48 is lowered whereby the valve seat 63 of the upper head cover 43 is closed by the valve body 66, the air in the chamber 53 disposed at the top surface of the piston 48 is released to atmosphere through the filter 56, whereas, when the piston 48 is raised whereby the valve seat 65 of the cap 64 is closed by the valve body 66, compressed air is supplied to the chamber 53 through the path 54. Additionally, received in the blind hole 58 of the piston 48 are a receiving base 67 being of a columnar form having a flange and a shock-absorbing spring 68, whereby, when the piston 48 is raised, a shock acting on the lower end of the shaft 61 is absorbed and an upwardly urging force is rendered to the shaft 61. Further, the ratio between the pressure receiving areas of the top and the bottom surfaces of the piston 48 is determined to be 1:2, whereby, when pressures equal in value with each other act on the top and bottom surfaces of the piston 48, the piston 48 is automatically lowered.

In addition, O-rings are provided at portions where the respective members of the cylinder 42 are connected to each other and hermetical seals are required.

OPERATION

Description will now be given to action of this embodiment with the abovedescribed arrangement.

In the state as shown, the piston 48 has reached the lower stroke end, the path 54 has been blocked by the change-over valve 55, and the chamber 53 disposed at the top surface of the piston 48 has been opened to atmosphere, while, the chamber 51 below the bottom surface of the piston 48 has been supplied with compressed air, so that the piston 48 is about to be moved upwardly. In this case, the plunger 6 connected to the piston 48 is lowered in unison with the downward movement of the piston 48, and the ball 36 of the inlet valve 37 is pressed against the valve seat 30 to block the path in accordance with the downward movement of the plunger 6, while, the valve body 24 of the discharge valve 29 is elevated by the pressure-fed fluid such as the paint and the like, the valve seat 28 is separated from the receiving seat 20, the fluid, which has been contained between the valve body 24 and the inlet valve 37, flows through the discharge valve 29 and enters the flow path 5A on the outer periphery of the bellows 11, and then, is discharged through the discharge port 5B. Furthermore, the socket 7 advances into the liquid 18 in accordance with the downward movement of the plunger 6, whereby the bellows 11 is expanded accordingly, however, because the outer diameter $D_1$ of the socket 7 is equal to the effective inner diameter $D_2$ of the bellows 11, whereby no variation occurs in pressure of the liquid 18 in the bellows 11 and in the space defined by the inner diameter of the lower case portion 5, so that any unusual deformation, breakage or other disadvantages can be avoided. Further, the quantity of discharge through the discharge port 5B is made to be ½ of the variation of volume due to the downward movement of the V-shaped packings 26 as aforesaid.

Subsequently, when the piston 48 enters its elevating process through the action of the compressed air being supplied to the chamber 51 disposed at the bottom surface of the piston 48, the plunger 6 is also elevated, whereby the valve body 24 of the discharge valve 29 is pressed downwardly by the pressure-fed fluid on the side of the flow path 5A, whereby the valve seat 28 is abutted against the receiving seat 20 to block the path, so that the pressure-fed fluid in the flow path 5A can be progressively discharged through the discharge port 5B in accordance with the upward movement of the valve body 24. While, the space upwardly of the inlet valve 37 is descreased in pressure in accordance with the upward movement of the valve body 24, whereby the ball 36 is raised to open the upper opening of the valve seat 30, so that the pressure-fed fluid sucked from a pressure-fed fluid tank, not shown, can flow into the lower space formed below the lower case portion 5 through the inlet valve 37. During this elevating process of the plunger 6, any deformation or the like of the bellows 11 does not occur under the reason as aforesaid. Further, the quantity of discharge through the discharge port 5B is also made to be ½ of the variation of volume due to the downward movement of the V-shaped packings 26 as described above, so that during both the elevating and lowering processes of the plunger 6, the fluid can be continuously discharged at the same quantity.

Now, the urging force of the compression coil spring 60 for pushing the shaft 61 downwardly and the urging force of the compressed air acting downwardly on the upper surface of the pressure receiving member 62 are set at their combined value satisfactorily larger than the value of the urging force of the compressed air acting upwardly on the undersurface of the valve body 66 being abutted against the valve seat 63, whereby even when the elevation of the piston 48 is initiated, the shaft 61 of the change-over valve 55 is not moved upwardly, so that the blocking of the valve seat 63 can be continued. Consequently, the chamber 53 disposed at the top surface of the piston 48 is continued to be opened to atmosphere, so that the elevation of the piston 48 can be continued.

Thus, the elevation of the piston 48 is continued as described above, the lower end of the shaft 61 abuts against the shock-absorbing spring 68 in the blind hole 58, and, when this spring 68 is deflected beyond a predetermined value, the upwardly urging force of this spring 68 and the upwardly urging force acting on the undersurface of the valve body 66, when combined, come to be larger than a combined value of the downwardly urging force of the compressed air acting on the upper surface of the pressure receiving member 62 and the urging force of the compression coil spring 60 being extended and progressively weakened in accordance with the upward movement of the piston 48, whereby the shaft 61 is rapidly elevated, so that the opening of the valve seat 63 and the closing of the valve seat 65 can be effected by the valve body 66. By this, the chamber 53 disposed at the top surface of the piston 48 is supplied with compressed air, whereby the lowering of the piston 48 is started due to the difference in pressure receiving area between the top and the bottom surfaces of the piston 48. In this case, since the valve body 66 is separated from the valve seat 63 having a small opening area, the undersurface of the valve body 66 as a whole forms a pressure receiving surface, and the pressure of the compressed air acting on this large pressure receiving surface renders an upwardly urging force to the shaft 61, so that the state where the shaft 61 tends to upwardly move, i.e. the blocking of the valve seat 65 on the side of atmosphere can be continued. With this arrangement, the piston continues the downward movement, in accordance with which the plunger 6 also moves downwardly, so that the pressure-fed fluid can be discharged during downward movement of the plunger 6 in the same manner as described above.

Thus, the piston 48 continues the downward movement, and, when the piston 48 reaches the stroke end, the urging force by the compressed spring 60 becomes very large in value, and this large urging force moves the shaft 61 downwardly to block the valve seat 63. Due to this blocking of the valve seat 63, the pressure receiving area becomes very small through the action of the valve seat 63, the upwardly urging force rendered to the valve body 66, i.e. the shaft 61 is decreased, so that the blocking of this valve seat 63 can be maintained. By this, the piston 48 is moved upwardly again. Thus, by repeating the abovedescribed action, the piston 48 and the plunger 6 are continuously reciprocated, so that the pressure-fed fluid can be discharged at the substantially same quantity during going and returning processes without any interruption.

In addition, prior to the driving of this pump, the liquid 18 such as oil for countering the pressure of the pressure-fed fluid to protect the bellows 11 is filled in the bellows 11 and the space defined by the inner diameter of the lower case portion 5 communicated with the interior of bellows 11. This filling operation is carried out such that the socket 7 provided on the upper portion of the plunger 6 is removed in the state where the plunger 6 is secured to the lower case portion 5 through the bellows 11, the liquid 18 of a given quantity is poured in through a gap formed between the plunger 6 and the inner periphery of the lower case portion 5, and then, the lower case portion 5 is slightly shaken, whereby foams and the like in the liquid 18 are easily removed, so that the foams and the like can be prevented from attaching to the ribs in the bellows 11.

In this embodiment with the abovedescribed arrangement, the inlet valve 37 provided in the lower case portion 5 of the plunger case 1 is formed of the ball valve, and the discharge valve 29 secured to the plunger 6 is formed of a valve including the valve body 24 movable relative to the plunger 6, whereby the use of expensive ball valves is limited to only one, so that a pump low in manufacturing costs can be provided. Furthermore, the pressure-fed fluid is not allowed to flow through the interior of the plunger 6, but, allowed to flow through the space formed around the outer periphery of the bellows 11, whereby, with this arrangement, the number of bellows 11 required is limited to only one, so that the manufacturing costs can be decreased and the pump as a whole can be rendered compact. Furthermore, since the inlet valve 37 is formed of a ball valve, and the discharge valve 29 is constituted by a valve including the movable valve body 24, this embodiment renders the pump simplified in construction as compared with the case where there is adopted an arrangement reverse to this embodiment, i.e. the ball valve is provided on the discharge valve 29, because, in this embodiment, the operational association between the movement of the plunger 6 and the plunger case 1 can be directly utilized for the movement of the valve. Further, through the action of the bellows 11, the pressure-fed fluid such as the coating composition including paint and the like does not come into contact with the slide portion between the plunger 6 and the plunger case 1 so that, when the inorganic paint, zinc rich paint or the like is fed under pressure, the plunger 6, the plunger case 1 and so force can be effectively protected against wear and a pump having general-purpose properties can be provided. Furthermore, the space around the outer periphery of the bellows 11 is formed into the flow path 5A and only the removal of the lower case portion 5 can expose the outer periphery of the bellows 11, so that the pressure-fed fluid such as the paint and the like adhered to the outer periphery of the bellows 11 can be readily removed. Further, the liquid 18 for protecting the bellows 11 is filled in the interior of the bellows 11 having the relatively large space and gap, whereby the foams in this liquid 18 are very easily removable, so that the liquid 18 can be filled in at a high efficiency without using any special filling apparatus and the like. Further, when oil is used as the liquid 18, the plunger 6 can slide smoothly. Additionally, the discharge can be effected during going and returning processes of the plunger 6, fluctuations in the quantity of discharge are low, so that the pump can be suitably used for pressure feed to a coating spray gun and other applications disagreeing to fluctuations in the quantity of discharge. Further, the flow of the pressure-fed flow is not in the rectilinear direction, but deviated at a right angle, so that the space required for piping in the vertical direction can be reduced and the pump as a whole can be rendered short in length. Furthermore, the cylinder 42 as the driving source can be automatically switched by means of the change-over valve 55, so that the pump according to the present invention can be provided at a lower cost than the pump in which switching is electrically effected by means of sequence controls and the like. Further, the outer diameter $D_1$ of the socket 7 of the plunger 6, i.e. the outer diameter of the portion of the plunger 6, which is slidable on the plunger case 1 and projected into the portion communicated with the interior of the bellows 11 is made equal in value to the effective diameter $D_2$ of the bellows 11, so that the bellows 11 can avoid such disadvantages as an unusual deformation, breakage and the like due to the linear movement of the plunger 6.

In addition, in working the present invention, the driving source should not necessarily be limited to the air cylinder 42, but, may be any other means including a combination of an electric motor with a cam or a crank. Furthermore, the construction of the valve body 24 should not necessarily be limited to the one as shown, but, may be another construction wherein the plurality of V-shaped packings 26 are replaced with one cup-shaped packing for example, in short, any construction can be adopted only if it achieves the abovedescribed operation. Further, in the abovedescribed embodiment, for convenience's sake, the movement of the piston 48 and the like are explained in the vertical direction, however, there is no harm in explaining it in the horizontal direction. Additionally, the discharge valve 29 and the inlet valve 37 should not necessarily be limited to the constructions shown in the abovedescribed embodiment, but, may be a construction in which the inlet valve 37 is formed of a poppet valve or the like for example.

As has been described hereinabove, the present invention can provide a plunger pump being low in manufacturing costs, having general-purpose properties and capable of readily cleaning bellows.

What is claimed is:

1. A plunger pump, comprising:

an elongate and hollow plunger case having an inlet port and an outlet port;

an elongate plunger reciprocally mounted in said plunger case;

drive means for effecting a reciprocal driving of said plunger;

inlet valve means on said plunger case adapted to control the input of fluid through said inlet port;

discharge valve means on said plunger spaced axially along said plunger from said inlet valve means and being adapted to control the output of fluid from said outlet port and in response to reciprocations of said plunger;

an elongate bellows encircling a portion of said plunger and being connected at one end to one end of said plunger case and extending in the interior of said plunger case, the other end of said bellows being connected to said plunger, the outer surface of said plunger being spaced from the interior surface of said plunger case to define a flow path therebetween for said fluid;

seal means for providing a fluid tight seal at the connections of said bellows to said plunger case and said plunger; and bellows deformation prevention means for preventing abnormal deformations of and maintaining a uniform diameter of said bellows as said plunger is reciprocated.

2. The plunger pump according to claim 1, wherein said bellows deformation prevention means includes an elongate chamber means in said plunger case and passageway means providing fluid communication between said chamber means and the interior of said bellows, the cross sectional area of said chamber means being equal to the effective cross sectional area of said bellows, said bellows deformation prevention means further including socket means movable into and out of said chamber means in response to reciprocal movement of said plunger, said socket means occupying a volume equal to the change in volume of said bellows caused by a reciprocation of said plunger, and a further fluid separate from said fluid to be pumped provided in said chamber means and bellows whereby said socket means serves to displace said further fluid in said chamber means and said bellows to effect a compensation in the change in internal volume of said bellows to thereby prevent abnormal deformations of said bellows as said plunger is reciprocated and said bellows is expanded and collapsed.

3. The plunger pump according to claim 2, including a sight window on said plunger case for observing said further fluid.

4. The plunger pump according to claim 1, wherein said inlet valve means is a ball valve; and wherein said discharge valve means includes a valve body mounted on said plunger, and packing means encircling said valve body and slidably engaging an internal wall surface of said plunger case encircling said valve body and packing means; and wherein the cross sectional area of said internal wall surface is two times that of said effective cross sectional area of said bellows.

5. The plunger pump according to claim 1, wherein said drive means comprises air operated air cylinder.

6. The plunger pump according to claim 5, wherein said air cylinder comprises a hollow casing mounted on said plunger case and having a piston reciprocally mounted therein and slidably engaging the internal wall surface of said casing, one side of said piston having an effective area equal to two times the effective cross sectional area of the opposite side thereof, and means for continually supplying compressed air to the opposite sides of said piston; and wherein the portion of the interior of said casing confronting the larger area portion of said piston includes change-over valve means for periodically, and in response to a selected position of said piston in said casing, connecting said interior portion to the atmosphere.

7. The plunger pump according to claim 6, wherein said change-over valve means comprises:

a reciprocal valve body provided in the path of flow of said compressed air and adapted to abut against a first valve seat for opening or closing said path and a second valve seat for opening or closing said path to said atmosphere, respectively;

a shaft secured at one end thereof to said valve body and inserted at the other end thereof into a blind hole formed at the central portion of said piston, said valve body being urged by a first spring in a direction of closing said path from a compressed air source to said larger area portion of said piston;

a pressure receiving member secured to said shaft and being opposed at opposite surfaces thereof to said path from said compressed air source and to the larger area portion of said piston, and means for effecting a decreasing of an opening area of said valve seat for opening or closing said path to effect a holding of said valve body in a state of blocking said path from said compressed air source in cooperation with said first spring; and a shock-absorbing second spring confined in said blind hole of said piston and is adapted to abut against the other end of said shaft to urge said valve body in a direction of opening said path from said compressed air source.

* * * * *